US011217160B2

(12) United States Patent
Gai et al.

(10) Patent No.: US 11,217,160 B2
(45) Date of Patent: Jan. 4, 2022

(54) PIXEL CIRCUIT AND METHOD OF DRIVING THE SAME, AND DISPLAY DEVICE

(71) Applicant: BOE TECHNOLOGY GROUP CO., LTD., Beijing (CN)

(72) Inventors: Cuili Gai, Beijing (CN); Yicheng Lin, Beijing (CN); Baoxia Zhang, Beijing (CN); Ling Wang, Beijing (CN); Quanhu Li, Beijing (CN); Pan Xu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 327 days.

(21) Appl. No.: 16/331,673

(22) PCT Filed: Aug. 16, 2018

(86) PCT No.: PCT/CN2018/100818

§ 371 (c)(1),
(2) Date: Mar. 8, 2019

(87) PCT Pub. No.: WO2019/047701

PCT Pub. Date: Mar. 14, 2019

(65) Prior Publication Data

US 2021/0166623 A1 Jun. 3, 2021

(30) Foreign Application Priority Data

Sep. 5, 2017 (CN) ..... 201710792864.5

(51) Int. Cl.
*G09G 3/3233* (2016.01)

(52) U.S. Cl.
CPC ... *G09G 3/3233* (2013.01); *G09G 2300/0819* (2013.01); *G09G 2320/0233* (2013.01); *G09G 2330/02* (2013.01)

(58) Field of Classification Search
CPC ..... G09G 3/3233; G09G 2320/0233; G09G 2330/02; G09G 2300/0819
See application file for complete search history.

(56) References Cited

U.S. PATENT DOCUMENTS

2011/0084947 A1* 4/2011 Chung ..... G09G 3/3233 345/211
2011/0164016 A1* 7/2011 Kang ..... G09G 3/3233 345/211

(Continued)

FOREIGN PATENT DOCUMENTS

CN 103594059 A 2/2014
CN 104700778 A 6/2015

(Continued)

OTHER PUBLICATIONS

International Search Report and Written Opinion issued in International Patent Application No. PCT/CN2018/100818, dated Nov. 7, 2018 (with English translation).

*Primary Examiner* — Jeff Piziali
(74) *Attorney, Agent, or Firm* — McDermott Will and Emery LLP

(57) ABSTRACT

A pixel circuit includes a data writing sub-circuit inputs a signal input via a second signal terminal to a compensating sub-circuit and a driving sub-circuit under control of a signal from a first signal terminal, the compensating sub-circuit compensates a threshold voltage of the driving sub-circuit according to a signal output from the data writing sub-circuit under control of a signal from a third signal terminal, a light-emitting control sub-circuit inputs a signal from a first voltage terminal to the driving sub-circuit and the compensating sub-circuit under control of a signal from a fourth signal terminal, the driving sub-circuit configured to generate and input a driving current to a light-emitting sub-circuit according to a signal output from the light-emitting control (Continued)

sub-circuit and a signal output from the data writing sub-circuit, and the light-emitting sub-circuit configured to emit light according to the driving current under control of a second voltage terminal.

8 Claims, 8 Drawing Sheets

(56) References Cited

U.S. PATENT DOCUMENTS

| | | | | |
|---|---|---|---|---|
| 2011/0193850 | A1* | 8/2011 | Chung | H05B 45/10 345/212 |
| 2011/0199357 | A1 | 8/2011 | Chung et al. | |
| 2012/0306843 | A1* | 12/2012 | Wang | G09G 3/3258 345/212 |
| 2013/0093800 | A1* | 4/2013 | Shim | G09G 3/3233 345/690 |
| 2013/0249857 | A1* | 9/2013 | Kimura | H01L 27/0629 345/174 |
| 2014/0022152 | A1* | 1/2014 | Guo | G09G 3/3233 345/82 |
| 2015/0187273 | A1* | 7/2015 | Chang | G09G 3/3233 345/690 |
| 2016/0005356 | A1 | 1/2016 | Zhang | |
| 2017/0039942 | A1 | 2/2017 | Han | |

FOREIGN PATENT DOCUMENTS

| | | | |
|---|---|---|---|
| CN | 107369412 | A | 11/2017 |
| CN | 207115975 | U | 3/2018 |
| GN | 103531151 | A | 1/2014 |

* cited by examiner

PIXEL CIRCUIT AND METHOD OF DRIVING THE SAME, AND DISPLAY DEVICE

CROSS-REFERENCE TO RELATED APPLICATION

This application is a national phase entry under 35 USC 371 of International Patent Application No. PCT/CN2018/100818 filed on Aug. 16, 2018, which claims priority to Chinese Patent Application No. 201710792864.5, submitted to Chinese Patent Office on Sep. 5, 2017, titled "PIXEL CIRCUIT AND METHOD OF DRIVING THE SAME, AND DISPLAY DEVICE", which are incorporated herein by reference in their entirety.

TECHNICAL FIELD

The present disclosure relates to the field of display technologies, and in particular, to a pixel circuit and a method of driving the same, and a display device.

BACKGROUND

An organic light emitting diode (OLED) display is one of focuses in the research field at present, and has a low power consumption, a low production cost, self-emission, a wide viewing angle, a high response speed and other advantages as compared with a liquid crystal display (LCD). A design of a pixel circuit is a core technology of the OLED display, which has important research significance.

SUMMARY

Some embodiments of the present disclosure provide a pixel circuit, and the pixel circuit includes a data writing sub-circuit, a compensating sub-circuit, a driving sub-circuit, a light-emitting control sub-circuit and a light-emitting sub-circuit.

The data writing sub-circuit is coupled to the compensating sub-circuit, the driving sub-circuit, a first signal terminal and a second signal terminal. The data writing sub-circuit is configured to input a signal input via the second signal terminal to the compensating sub-circuit and the driving sub-circuit under control of a signal from the first signal terminal.

The compensating sub-circuit is further coupled to the driving sub-circuit and a third signal terminal. The compensating sub-circuit is configured to compensate a threshold voltage of the driving sub-circuit according to a signal output from the data writing sub-circuit under control of a signal from the third signal terminal.

The light-emitting control sub-circuit is coupled to the compensating sub-circuit, the driving sub-circuit, a fourth signal terminal and a first voltage terminal. The light-emitting control sub-circuit is configured to input a signal from the first voltage terminal to the driving sub-circuit and the compensating sub-circuit under control of a signal from the fourth signal terminal.

The driving sub-circuit is further coupled to the light-emitting sub-circuit. The driving sub-circuit is configured to generate and input a driving current to the light-emitting sub-circuit according to a signal output from the light-emitting control sub-circuit and a signal output from the data writing sub-circuit.

The light-emitting sub-circuit is further coupled to a second voltage terminal. The light-emitting sub-circuit is configured to emit light according to the driving current output from the driving sub-circuit under control of a power supply voltage input via the second voltage terminal.

In some embodiments, the data writing sub-circuit includes a first transistor. A gate of the first transistor is coupled to the first signal terminal, a first electrode of the first transistor is coupled to the second signal terminal, and a second electrode of the first transistor is coupled to the compensating sub-circuit and the driving sub-circuit.

In some embodiments, the compensating sub-circuit includes a second transistor and a first capacitor.

A first end of the first capacitor is coupled to the data writing sub-circuit, and a second end of the first capacitor is coupled to a first electrode of the second transistor. A gate of the second transistor is coupled to the third signal terminal, and a second electrode of the second transistor is coupled to the driving sub-circuit.

In some embodiments, the driving sub-circuit includes a third transistor and a second capacitor.

A first end of the second capacitor is coupled to the first end of the first capacitor, and a second end of the second capacitor is coupled to a second electrode of the third transistor. A gate of the third transistor is coupled to the second end of the first capacitor, a first electrode of the third transistor is coupled to the second electrode of the second transistor, and the second electrode of the third transistor is further coupled to the light-emitting sub-circuit.

In some embodiments, the light-emitting sub-circuit includes a light-emitting device. An anode of the light-emitting device is coupled to the driving sub-circuit, and a cathode of the light-emitting device is coupled to the second voltage terminal.

In some embodiments, the light-emitting device is an OLED.

In some embodiments, the light-emitting control sub-circuit includes a fourth transistor.

A gate of the fourth transistor is coupled to the fourth signal terminal, a first electrode of the fourth transistor is coupled to the first voltage terminal, and a second electrode of the fourth transistor is coupled to the driving sub-circuit and the compensating sub-circuit.

In some embodiments, transistors included in the pixel circuit are all N-type transistors.

Some embodiments of the present disclosure provide a display device, and the display device includes a plurality of pixel circuits described above.

In some embodiments, third signal terminals of some of the plurality of pixel circuits are coupled to a same signal input terminal, and fourth signal terminals of some of the plurality of pixel circuits are coupled to a same signal input terminal.

Some embodiments of the present disclosure provide a method of driving a pixel circuit, and the method includes:

in an initialization period of a frame, inputting, by the data writing sub-circuit, a reset control signal input via the second signal terminal to the compensating sub-circuit and the driving sub-circuit under the control of the signal from the first signal terminal, to initialize the compensating sub-circuit and the driving sub-circuit;

in a compensation period of the frame, inputting, by the data writing sub-circuit, a compensating control signal input via the second signal terminal to the compensating sub-circuit under the control of a signal from the first signal terminal, and compensating, by the compensating sub-circuit, the threshold voltage of the driving sub-circuit under the control of a signal from the third signal terminal;

in a data writing period of the frame, inputting, by the data writing sub-circuit, a data signal input via the second signal terminal to the driving sub-circuit under the control of a signal from the first signal terminal and storing the data signal in the driving sub-circuit; and in a light-emitting period of the frame, inputting, by the light-emitting control sub-circuit, the power supply voltage input via the first voltage terminal to the driving sub-circuit under the control of a signal from the fourth signal terminal, so that the driving sub-circuit generates a driving current; and emitting, by the light-emitting sub-circuit, light according to the driving current under the control of the power supply voltage input via the second voltage terminal.

In some embodiments, in the initialization period of the frame, the method further includes: inputting, by the light-emitting control sub-circuit and the compensating sub-circuit, a reset voltage input via the first voltage terminal to the driving sub-circuit through the compensating sub-circuit under the control of a signal from the fourth signal terminal and a signal from the third signal terminal, respectively, to initialize the driving sub-circuit.

In some embodiments, the data writing sub-circuit includes a first transistor, the compensating sub-circuit includes a second transistor and a first capacitor, and the driving sub-circuit includes a third transistor and a second capacitor.

On this basis, in the initialization period of a frame, inputting, by the data writing sub-circuit, the reset control signal input via the second signal terminal to the compensating sub-circuit and the driving sub-circuit under the control of the signal from the first signal terminal, to initialize the compensating sub-circuit and the driving sub-circuit, includes:

in the initialization period of the frame, inputting a turn-on signal via the first signal terminal to control the first transistor to be turned on, outputting, by the first transistor, the reset control signal input via the second signal terminal to the first capacitor and the second capacitor, to initialize the first capacitor and the second capacitor.

In some embodiments, in the compensation period of the frame, inputting, by the data writing sub-circuit, the compensating control signal input via the second signal terminal to the compensating sub-circuit under the control of the signal from the first signal terminal, and compensating, by the compensating sub-circuit, the threshold voltage of the driving sub-circuit under the control of the signal from the third signal terminal, includes:

in the compensation period of the frame, inputting a turn-on signal via the first signal terminal to control the first transistor to be turned on, and outputting, by the first transistor, the compensating control signal input via the second signal terminal to the compensating sub-circuit, and inputting a turn-on signal via the third signal terminal to control the second transistor to be turned on, to compensate the threshold voltage of the driving sub-circuit.

In some embodiments, in the data writing period of the frame, inputting, by the data writing sub-circuit, the data signal input via the second signal terminal to the driving sub-circuit under the control of the signal from the first signal terminal and storing the data signal in the driving sub-circuit, includes:

in the data writing period of the frame, inputting a turn-on signal via the first signal terminal to control the first transistor to be turned on, and outputting, by the first transistor, the data signal input via the second signal terminal to the second capacitor and storing the data signal in the second capacitor.

In some embodiments, the light-emitting control sub-circuit includes a fourth transistor. Based on this, in the light-emitting period of the frame, inputting, by the light-emitting control sub-circuit, the power supply voltage input via the first voltage terminal to the driving sub-circuit under the control of the signal from the fourth signal terminal, so that the driving sub-circuit generates a driving current, includes:

in the light-emitting period of the frame, inputting a turn-on signal via the fourth signal terminal to control the fourth transistor to be turned on, and inputting, by the fourth transistor, the power supply voltage input via the first voltage terminal to the driving sub-circuit, so that the driving sub-circuit generates a driving current.

In some embodiments, the data writing sub-circuit includes a first transistor, the compensating sub-circuit includes a second transistor and a first capacitor, the driving sub-circuit includes a third transistor and a second capacitor, and the light-emitting control sub-circuit includes a fourth transistor. Based on this, inputting, by the light-emitting control sub-circuit and the compensating sub-circuit, the reset voltage input via the first voltage terminal to the driving sub-circuit through the compensating sub-circuit under the control of the signal from the fourth signal terminal and the signal from the third signal terminal, respectively, to initialize the driving sub-circuit, includes:

inputting a turn-on signal via the fourth signal terminal to control the fourth transistor to be turned on, outputting, by the fourth transistor, the reset voltage input via the first voltage terminal to a gate of the third transistor, to initialize the third transistor.

BRIEF DESCRIPTION OF THE DRAWINGS

In order to describe technical solutions in embodiments of the present disclosure or in the related art more clearly, the accompanying drawings to be used in the description of embodiments of the present disclosure or the related art will be introduced briefly. Obviously, the accompanying drawings to be described below are merely some embodiments of the present disclosure, and a person of ordinary skill in the art can obtain other drawings according to these drawings without paying any creative effort.

FIG. 3(*b*) is a diagram showing another timing of each signal used for driving the pixel circuit shown in FIG. 2 according to some embodiments of the present disclosure;

DETAILED DESCRIPTION

The technical solutions in embodiments of the present disclosure will be described clearly and completely with reference to the accompanying drawings in embodiments of the present disclosure. Obviously, the described embodiments are merely some but not all of embodiments of the present disclosure. All other embodiments made on the basis of the embodiments of the present disclosure by a person of ordinary skill in the art without paying any creative effort shall be included in the protection scope of the present disclosure.

An active-matrix organic light emitting diode (AMOLED) uses thin film transistors (TFTs) for constructing a pixel circuit to provide a corresponding current for an OLED device. Low temperature poly-silicon thin film transistors (LTPS TFTs) or oxide thin film transistors (Oxide TFTs) are often used. However, the LTPS TFTs or Oxide TFTs formed on a large area glass substrate usually have a problem of threshold voltage drift. Since a difference in the threshold voltage drifts of the TFTs on different parts of the display panel may lead to a difference in display luminance, the luminance of the pixels is not uniform.

Figure 1:
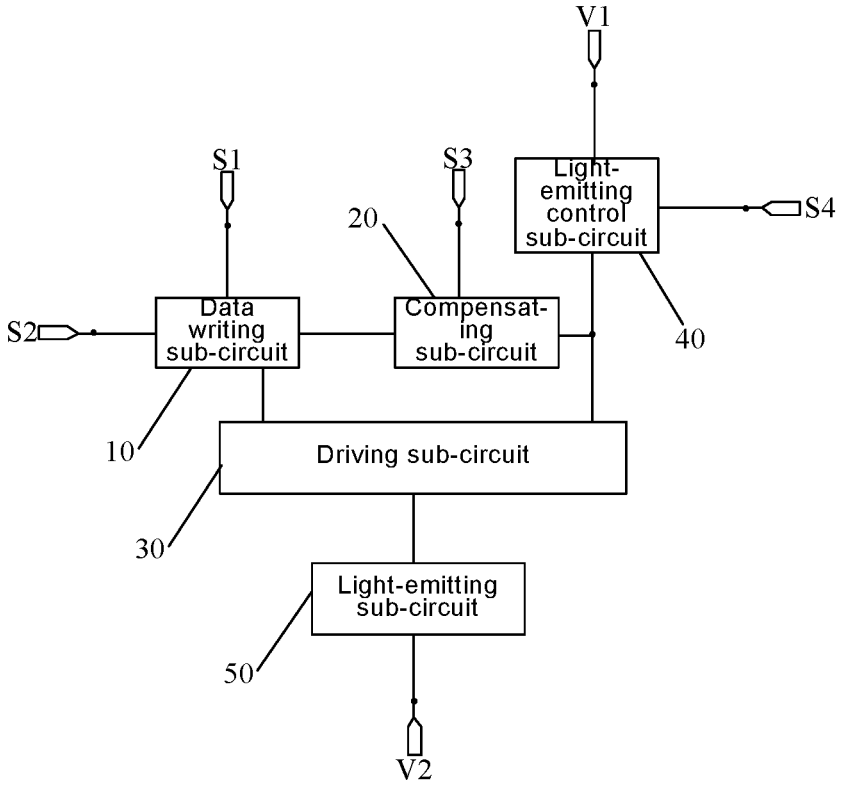
FIG. 1 is a schematic diagram showing a structure of a pixel circuit according to some embodiments of the present disclosure.

Based on this, some embodiments of the present disclosure provide a pixel circuit. As shown in FIG. 1, the pixel circuit includes a data writing sub-circuit 10, a compensating sub-circuit 20, a driving sub-circuit 30, a light-emitting control sub-circuit 40 and a light-emitting sub-circuit 50.

The data writing sub-circuit 10 is coupled to the compensating sub-circuit 20, the driving sub-circuit 30, a first signal terminal S1 and a second signal terminal S2. The data writing sub-circuit 10 is configured to input a signal from the second signal terminal S2 to the compensating sub-circuit 20 and the driving sub-circuit 30 under control of a signal from the first signal terminal S1.

The compensating sub-circuit 20 is further coupled to the driving sub-circuit 30 and a third signal terminal S3. The compensating sub-circuit 20 is configured to compensate a threshold voltage of the driving sub-circuit 30 according to a signal output from the data writing sub-circuit 10 under control of a signal from the third signal terminal S3.

The light-emitting control sub-circuit 40 is coupled to the compensating sub-circuit 20, the driving sub-circuit 30, a fourth signal terminal S4 and a first voltage terminal V1. The light-emitting control sub-circuit 40 is configured to input a signal from the first voltage terminal V1 to the driving sub-circuit 30 and the compensating sub-circuit 20 under control of a signal from the fourth signal terminal S4.

The driving sub-circuit 30 is further coupled to the light-emitting sub-circuit 50. The driving sub-circuit 30 is configured to generate a driving current according to a signal output from the light-emitting control sub-circuit 40 and a signal output from the data writing sub-circuit 10 and input the driving current to the light-emitting sub-circuit 50.

The light-emitting sub-circuit 50 is further coupled to a second voltage terminal V2. The light-emitting sub-circuit 50 is configured to emit light according to the driving current output from the driving sub-circuit 30 under control of the second voltage terminal V2.

In the pixel circuit provided by some embodiments of the present disclosure, the compensating sub-circuit 20 is added in the pixel circuit for compensating the threshold voltage of the driving sub-circuit 30, thereby avoiding the difference in display luminance due to the difference in the threshold voltage drifts of the TFTs on different parts of the display panel, and improving the luminance uniformity among the pixels.

Figure 2:
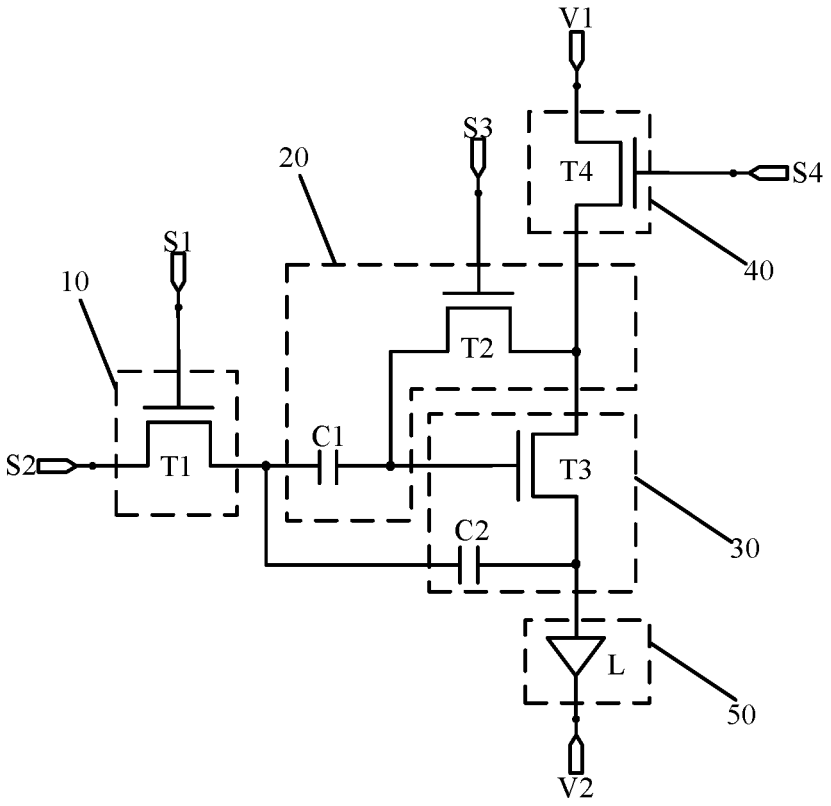
FIG. 2 is a schematic diagram showing specific structures of sub-circuits of the pixel circuit shown in FIG. 1.

In some embodiments, as shown in FIG. 2, the data writing sub-circuit 10 includes a first transistor T1.

A gate of the first transistor T1 is coupled to the first signal terminal S1, a first electrode of the first transistor T1 is coupled to the second signal terminal S2, and a second electrode of the first transistor T1 is coupled to the compensating sub-circuit 20 and the driving sub-circuit 30.

It will be noted that in some other embodiments, the data writing sub-circuit 10 further includes a plurality of switching transistors coupled in parallel with the first transistor T1. The foregoing description is merely an example of the data writing sub-circuit 10. Other structures having a same function as the data writing sub-circuit 10 are not elaborated herein, but all shall be included in the protection scope of the present disclosure.

In some embodiments, as shown in FIG. 2, the compensating sub-circuit 20 includes a second transistor T2 and a first capacitor C1.

A first end of the first capacitor C1 is coupled to the data writing sub-circuit 10, and a second end of the first capacitor C1 is coupled to a first electrode of the second transistor T2.

A gate of the second transistor T2 is coupled to the third signal terminal S3, and a second electrode of the second transistor T2 is coupled to the driving sub-circuit 30.

In a case where the data writing sub-circuit 10 includes the first transistor T1, the first end of the first capacitor C1 is coupled to the second electrode of the first transistor T1.

It will be noted that in some other embodiments, the compensating sub-circuit 20 further includes a plurality of switching transistors coupled in parallel with the second transistor T2. The foregoing description is merely an example of the compensating sub-circuit 20. Other structures having the same function as the compensating sub-circuit 20 are not elaborated herein, but all shall be included in the protection scope of the present disclosure.

In some embodiments, as shown in FIG. 2, the driving sub-circuit 30 includes a third transistor T3 and a second capacitor C2.

A first end of the second capacitor C2 is coupled to the first end of the first capacitor C1 and the data writing sub-circuit 10, and a second end of the second capacitor C2 is coupled to a second electrode of the third transistor T3.

A gate of the third transistor T3 is coupled to the second end of the first capacitor C1, a first electrode of the third transistor T3 is coupled to the second electrode of the second transistor T2 and the light-emitting control sub-circuit 40, and the second electrode of the third transistor T3 is further coupled to the light-emitting sub-circuit 50.

Here, the third transistor T3 is a driving transistor.

In a case where the data writing sub-circuit 10 includes the first transistor T1, the first end of the second capacitor C2 is coupled to the second electrode of the first transistor T1 and the first end of the first capacitor C1.

It will be noted that in some other embodiments, the driving sub-circuit 30 further includes a plurality of driving transistors coupled in parallel with the third transistor T3. The foregoing description is merely an example of the driving sub-circuit 30. Other structures having the same function as the driving sub-circuit 30 are not elaborated herein, but all shall be included in the protection scope of the present disclosure.

In some embodiments, as shown in FIG. 2, the light-emitting control sub-circuit 40 includes a fourth transistor T4.

A gate of the fourth transistor T4 is coupled to the fourth signal terminal S4, a first electrode of the fourth transistor T4 is coupled to the first voltage terminal V1, and a second electrode of the fourth transistor T4 is coupled to the driving sub-circuit 30 and the compensating sub-circuit 20.

In a case where the compensating sub-circuit 20 includes the second transistor T2 and the first capacitor C1, and the driving sub-circuit 30 includes the third transistor T3 and the second capacitor C2, the second electrode of the fourth transistor T4 is coupled to the first electrode of the third transistor T3 and the second electrode of the second transistor T2.

It will be noted that in some other embodiments, the light-emitting control sub-circuit 40 further includes a plurality of switching transistors coupled in parallel with the fourth transistor T4. The foregoing description is merely an example of the light-emitting control sub-circuit 40. Other structures having the same function as the light-emitting control sub-circuit 40 are not elaborated herein, but all shall be included in the protection scope of the present disclosure.

In some embodiments, as shown in FIG. 2, the light-emitting sub-circuit 50 includes a light-emitting device L. An anode of the light-emitting device L is coupled to the driving sub-circuit 30, and a cathode of the light-emitting device L is coupled to the second voltage terminal V2.

In some embodiments, the light-emitting device L is an OLED.

In a case where the driving sub-circuit 30 includes the third transistor T3, the anode of the light-emitting device L is coupled to the second electrode of the third transistor T3.

Based on the above description of the specific circuit structure of each sub-circuit, the specific driving process of the pixel driving circuit described above will be described in detail below in combination with FIGS. 2, 3(*a*) and 3(*b*).

It will be noted that embodiments of the present disclosure do not limit types of the transistors in each sub-circuit. In some embodiments, the first transistor T1, the second transistor T2, the third transistor T3 and the fourth transistor T4 are N-type transistors. In some other embodiments, the first transistor T1, the second transistor T2, the third transistor T3 and the fourth transistor T4 are P-type transistors.

In some embodiments, the first electrode of the transistor is a drain and the second electrode is a source. In some other embodiments, the first electrode is a source and the second electrode is a drain.

In addition, according to different conductive methods of transistors, the transistors in the pixel circuit described above may be divided into enhancement-mode transistors and depletion-mode transistors. The embodiments of the present disclosure do not limit this.

The following embodiments will be illustrated by taking an example in which the transistors (the first transistor T1, the second transistor T2, the third transistor T3 and the fourth transistor T4) described above are all N-type transistors. Moreover, the following embodiments will be illustrated by taking an example in which a high level is input via the first voltage terminal V1, and a low level is input via the second voltage terminal V2, or the second voltage terminal V2 is grounded. It will be understood that the terms "high" and "low" here merely indicate a relative magnitude relationship between voltages that are input.

Figure 3A:
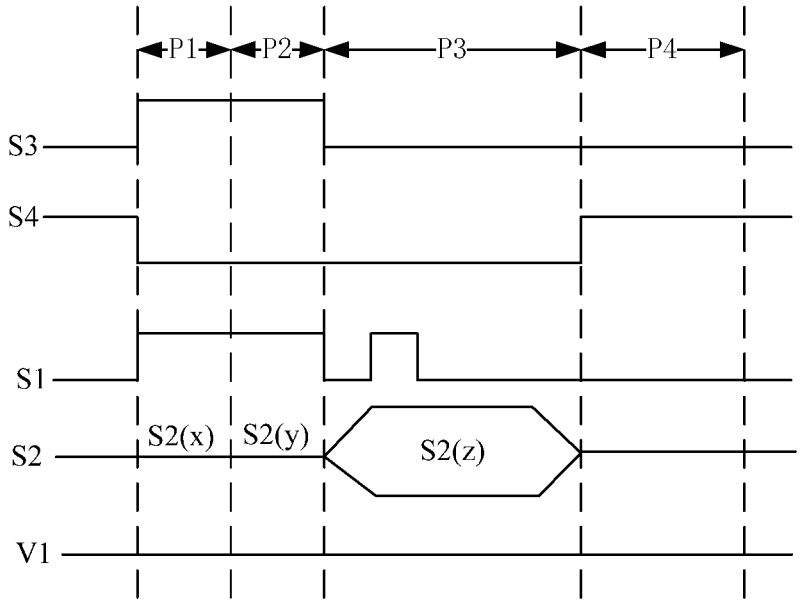
FIG. 3(*a*) is a diagram showing a timing of each signal used for driving the pixel circuit shown in FIG. 2 according to some embodiments of the present disclosure.
Figure 3B:
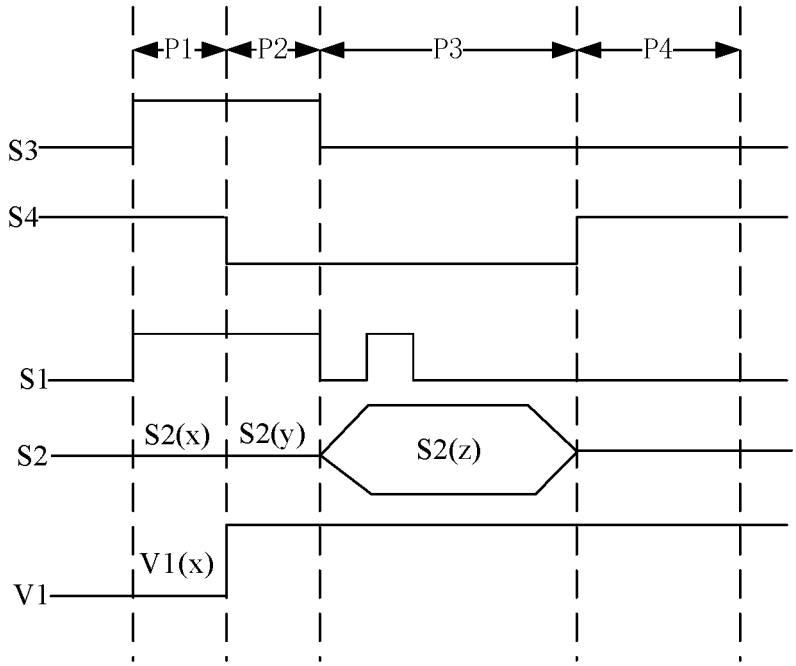

As shown in FIGS. 3(*a*) and 3(*b*), a display process of the pixel circuit in each frame is divided into an initialization period P1, a compensation period P2, a data writing period P3 and a light-emitting period P4.

Figure 4:
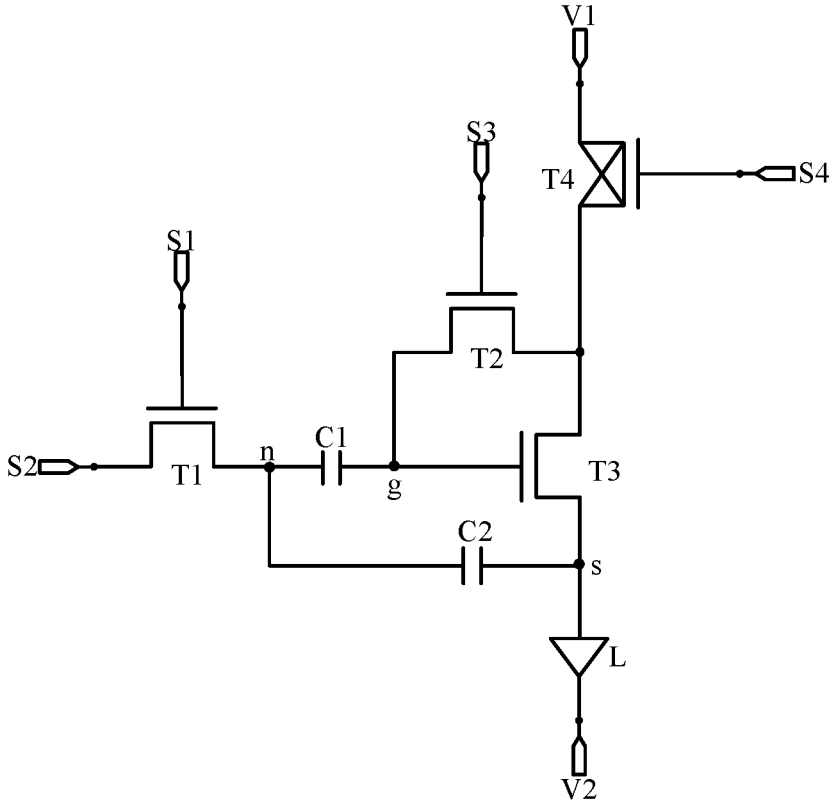
FIGS. 4-7 are equivalent circuit diagrams of the pixel circuit shown in FIG. 2 in different cases.

In some embodiments, as shown in FIG. 3(*a*), in the initialization period P1 of a frame, high level turn-on signals are respectively input via the first signal terminal S1 and the third signal terminal S3, and a low level cut-off signal is input via the fourth signal terminal S4. Based on this, the equivalent circuit diagram of the pixel circuit shown in FIG. 2 is as shown in FIG. 4. The first transistor T1, the second transistor T2 and the third transistor T3 are all turned on, and the fourth transistor T4 is cut off. The transistor in an off state is indicated by a symbol "x".

When the high level turn-on signal is input via the first signal terminal S1 to control the first transistor T1 to be turned on, a reset control signal S2(*x*) input via the second signal terminal S2 is transmitted to the first end of the first capacitor C1 and the first end of the second capacitor C2, i.e., a node n in FIG. 4, through the first transistor T1, so as to initialize the first capacitor C1 and the second capacitor C2.

Figure 5:
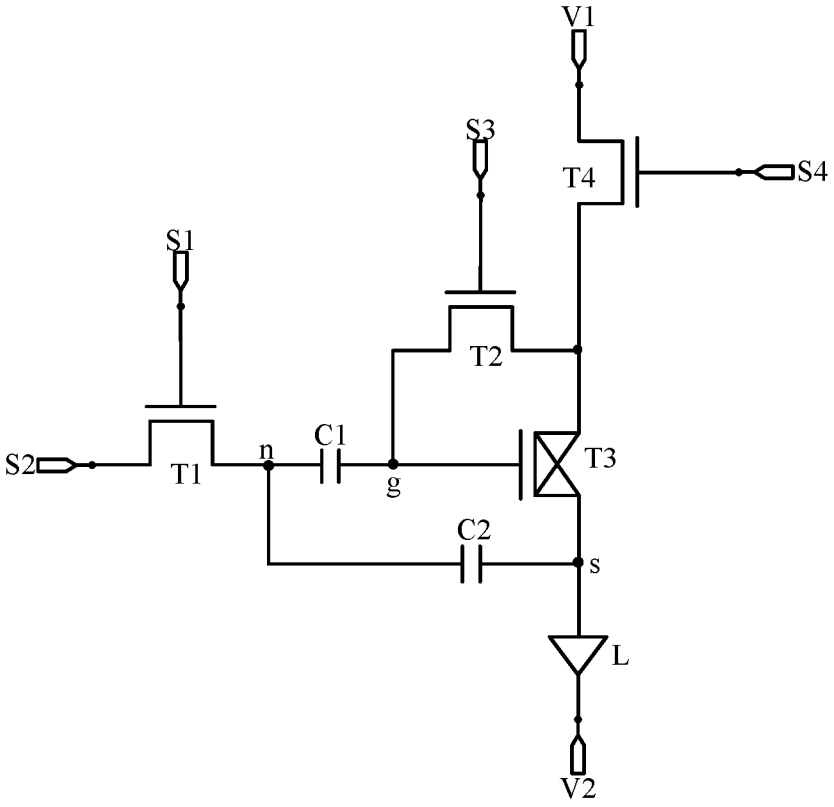

In some other embodiments, as shown in FIG. 3(*b*), in the initialization period P1 of a frame, high level turn-on signals are input via the first signal terminal S1, the third signal terminal S3 and the fourth signal terminal S4 respectively. Based on this, the equivalent circuit diagram of the pixel circuit shown in FIG. 2 is as shown in FIG. 5. The first transistor T1, the second transistor T2 and the fourth transistor T4 are all turned on, and the third transistor T3 is cut off.

When the high level turn-on signal is input via the first signal terminal S1 to control the first transistor T1 to be turned on, the reset control signal S2(*x*) input via the second signal terminal S2 is transmitted to the first end of the first capacitor C1 and the first end of the second capacitor C2, i.e., a node n in FIG. 5, through the first transistor T1, so as to initialize the first capacitor C1 and the second capacitor C2. Meanwhile, when the high level turn-on signal is input via the fourth signal terminal S4 to control the fourth transistor T4 to be turned on, a reset voltage V1(*x*) input via the first voltage terminal V1 is transmitted to the gate, i.e, a node g in FIG. 5, of the third transistor T3 through the fourth transistor T4, so as to initialize the third transistor T3. In this case, in order to prevent the light-emitting sub-circuit 50 from emitting light, the reset voltage V1(*x*) input via the first voltage terminal V1 will control the third transistor T3 to be cut off.

As shown in FIGS. 3(*a*) and 3(*b*), in the compensation period P2 of the frame, high level turn-on signals are input via the first signal terminal S1 and the third signal terminal S3 respectively, and the low level cut-off signal is input via the fourth signal terminal S4. Based on this, the equivalent circuit diagram of the pixel circuit shown in FIG. 2 is as shown in FIG. 4, the first transistor T1, the second transistor T2 and the third transistor T3 are all turned on, and the fourth transistor T4 is cut off.

When the high level turn-on signal is input via the first signal terminal S1 to control the first transistor T1 to be turned on, a compensating control signal S2(*y*) input via the second signal terminal S2 is transmitted to the compensating sub-circuit 20 through the first transistor T1. Meanwhile, when the turn-on signal is input via the third signal terminal S3 to control the second transistor T2 to be turned on, the second transistor T2 electrically connects the gate of the third transistor T3 and the first electrode of the third transistor T3, and releases the voltages of the nodes g and s, so that the voltage at the node s is VSS+Voled0, and the voltage at the node g is VSS+Voled0+Vth, thereby compensating the threshold voltage of the driving sub-circuit 30. VSS is the power supply voltage of the second voltage terminal V2, Voled0 is the voltage when the light-emitting device does not emit light, and Vth is a threshold voltage of the third transistor T3.

In some embodiments, the reset control signal S2(*x*) and the compensating control signal S2(*y*) input via the second signal terminal S2 are the same. On this basis, if in the initialization period P1, the high level turn-on signal is not input via the fourth signal terminal S4 (that is, as shown in FIG. 3(*a*), a low level cut-off signal is input via the fourth signal terminal S4), the initialization period P1 and the compensation period P2 shown in FIG. 3(*a*) may be combined into one period to be performed.

As a result, at the end of the compensation period P2, the voltage at the node n is Vref, the voltage at the node s is VSS+Voled0, and the voltage at the node g is VSS+Voled0+Vth. Vref is the voltage of the compensating control signal.

Figure 6:
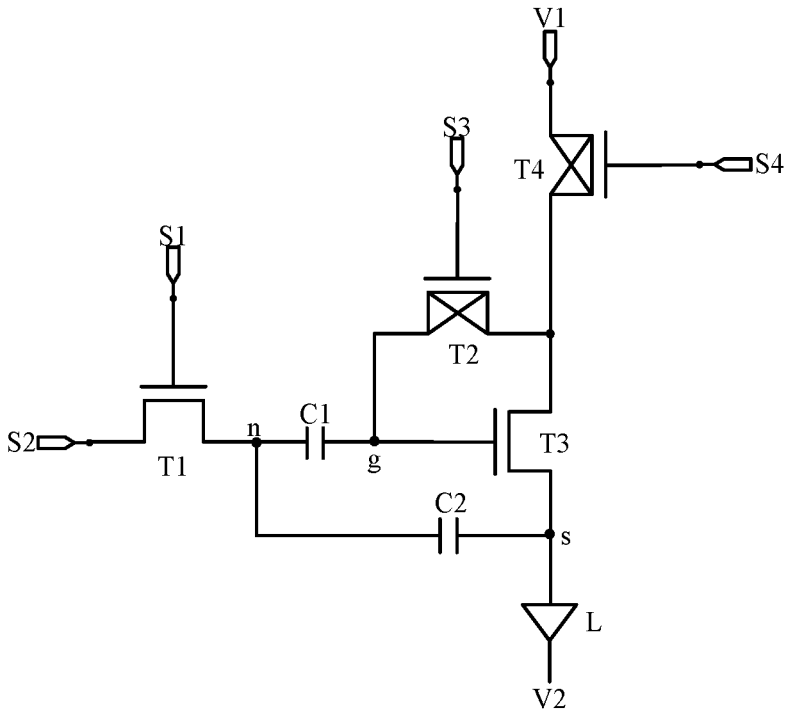

As shown in FIGS. 3(*a*) and 3(*b*), in the data writing period P3 of the frame, the high level turn-on signal is input via the first signal terminal S1, and the low level cut-off signals are input via the third voltage terminal S3 and the fourth voltage terminal S4 respectively. Based on this, the equivalent circuit diagram of the pixel circuit shown in FIG. 2 is as shown in FIG. 6. The first transistor T1 and the third transistor T3 are both turned on, and the second transistor T2 and the fourth transistor T4 are cut off.

When the high level turn-on signal is input via the first signal terminal S1 to control the first transistor T1 to be turned on, a data signal S2(*z*) input via the second signal terminal S2 is transmitted to the second capacitor C2 through the first transistor T1 and stored in the second capacitor C2. In this case, the voltage at the node n jumps to Vdata, the jump variable ΔV is a difference between Vdata and Vref (ΔV=Vdata-Vref), and the voltage at the node g is changed to a difference between (a sum of VSS, Voled0, Vth, and Vdata) and Vref (i.e., VSS+Voled0+Vth+Vdata-Vref) due to a capacitive coupling effect of the C2.

As a result, at the end of the compensation period P2, the voltage at the node n is Vdata, the voltage at the node s is a sum of VSS and Voled0 (VSS+Voled0), and the voltage at the node g is a difference between (a sum of VSS, Voled0, Vth, and Vdata) and Vref (i.e., VSS+Voled0+Vth+Vdata−Vref). Vdata is the voltage of the data signal.

It will be noted that when the pixel circuit is applied to a display panel, the first signal terminals S1 of the pixel circuits in each row are coupled to a gate line, and gate lines output signals row by row, so that in the data writing period P3, the high level turn-on signal is input via the first signal terminal S1.

Figure 7:
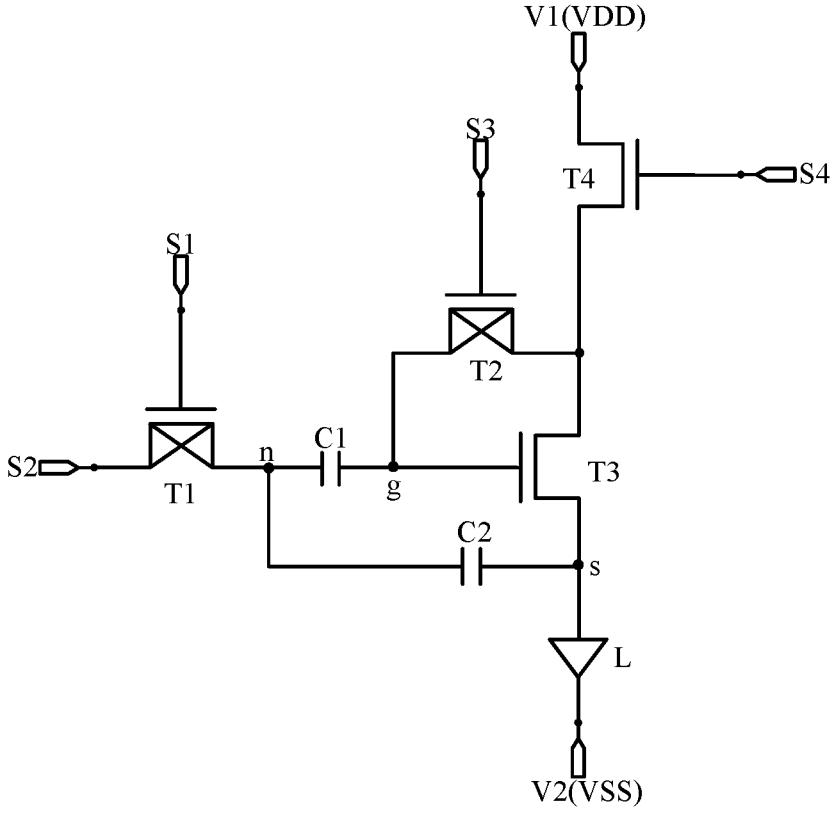

As shown in FIGS. 3(*a*) and 3(*b*), in the light-emitting period P4 of the frame, the high level turn-on signal is input via the fourth signal terminal S4, and the low level cut-off signals are input via the third voltage terminal S3 and the first signal terminal S1 respectively. Based on this, the equivalent circuit diagram of the pixel circuit shown in FIG. 2 is as shown in FIG. 7. The third transistor T3 and the fourth transistor T4 are both turned on, and the first transistor T1 and the second transistor T2 are cut off.

When the high level turn-on signal is input via the fourth signal terminal S4 to control the fourth transistor T4 to be turned on, the power supply voltage VDD input via the first voltage terminal V1 is transmitted to the driving sub-circuit 30 through the fourth transistor T4. The driving sub-circuit 30 generates a driving current according to the power supply voltage VDD and the data signal and inputs the driving current to the light-emitting device L to drive the light-emitting device L to emit light.

In the light-emitting period P4, the voltage at the node g is a difference between (a sum of VSS, Voled0, Vth, and Vdata) and Vref (i.e., VSS+Voled0+Vth+Vdata-Vref), and the voltage at the node s is a sum of VSS and Voled (i.e., VSS+Voled). Voled is the voltage when the light-emitting device emits light.

After the third transistor T3 is turned on, when a value obtained by subtracting the threshold voltage Vth of the third transistor T3 from a gate-source voltage Vgs of the third transistor T3 is less than or equal to a drain-source voltage Vds of the third transistor T3, that is, when Vgs−Vth≤Vds, the third transistor T3 may be in a saturation and turn-on state. In this case, the driving current I flowing through the third transistor T3 is:

$$I_{oled} = \frac{1}{2}k(Vgs - Vth)^2 = \frac{1}{2}k(VSS + Voled0 + Vth + Vdata - Vref - VSS - Voled - Vth)^2 = \frac{1}{2}k(Voled0 - Voled + Vdata - Vref)^2$$

Where K=W/L×C×u, W/L is a width-to-length ratio of the driving transistor Td, C is a dielectric constant of a channel insulating layer, and u is a channel carrier mobility.

It can be seen that the driving current I flowing through the third transistor T3 is only related to a structure of the third transistor T3, the data signal input via the second signal terminal S2 and the compensating control signal input via the second signal terminal S2, and has nothing to do with the threshold voltage Vth of the third transistor T3, thereby eliminating an influence of the threshold voltage Vth of the third transistor T3 on luminance of the light-emitting device L, and improving the luminance uniformity of light-emitting devices L. Moreover, since the driving current of the third transistor T3 has nothing to do with the VSS, the problem of non-uniform display due to the influence of a voltage drop on a VSS line may be solved. Furthermore, the driving current of the third transistor T3 is related to a difference between Voled0 and Voled, and may compensate the non-uniform display to some extent which is caused by an aging of the light-emitting device L.

Figure 8:
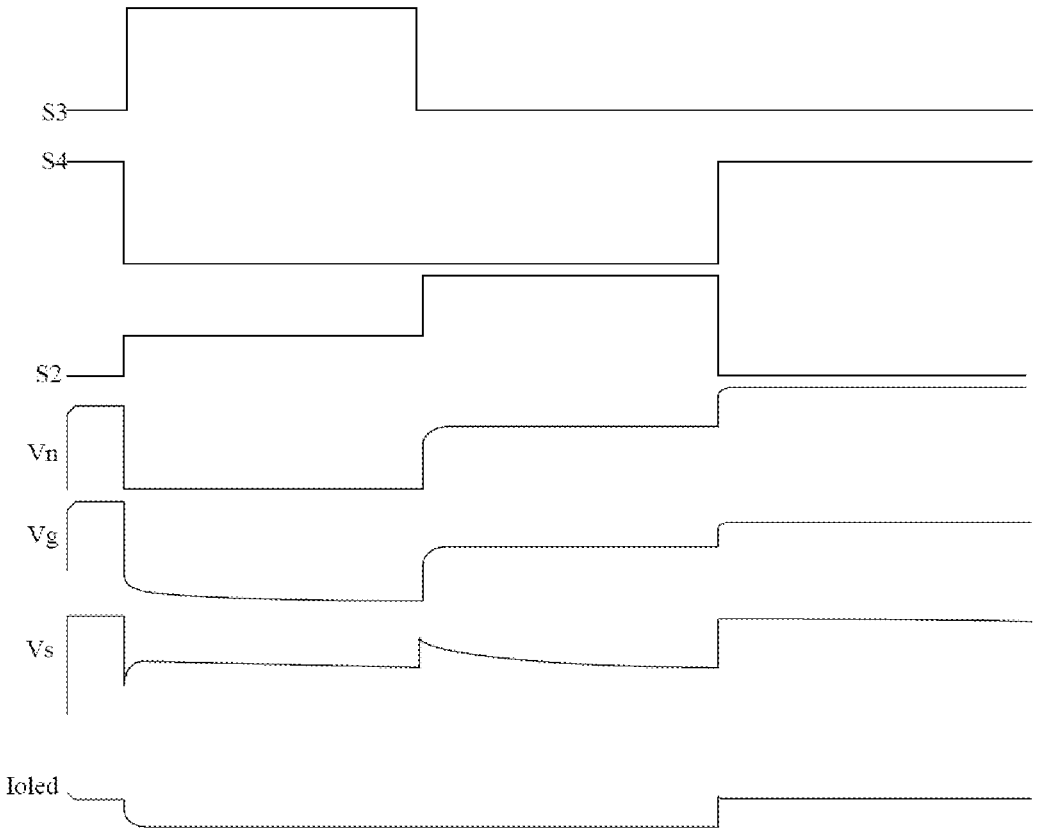
FIG. 8 is a schematic diagram showing a simulation effect of a pixel circuit according to some embodiments of the present disclosure.

FIG. 8 is a schematic diagram showing a simulation effect of a pixel circuit after performing a simulation experiment according to some embodiments of the present disclosure. As can be seen from FIG. 8, when the Vth is different, for example, in a case where the Vth is equal to 1 v and in another case where the Vth is equal to 2 v, light-emitting currents obtained are the same. It can be seen that the pixel circuit provided by some embodiments of the present disclosure well compensates the non-uniformity of the Vth of the third transistor T3.

Some embodiments of the present disclosure provide a display device, and the display device includes a plurality of pixel circuits described above.

The display device may be any product or component having a display function such as an OLED display, a digital photo frame, a mobile phone, a tablet computer and a navigator.

Some embodiments of the present disclosure provide a display device, and the display device includes any type of the pixel circuits described above. The display device includes a plurality of pixel units in an array, and each pixel unit includes any one of the pixel circuits described above. The display device provided by some embodiments of the present disclosure has the same beneficial effects as the pixel circuit provided by some embodiments of the present disclosure, which is not elaborated here.

In some embodiments, third signal terminals S3 of the plurality of pixel circuits are coupled to a same signal input terminal, and fourth signal terminals S4 of the plurality of pixel circuits are coupled to a same signal input terminal.

In periods of the pixel circuit, the display device do not emit light in a full screen in the initialization period P1, the compensation period P2, and the data writing period P3, and the initialization period P1 and the compensation period P2 may be simultaneously performed. The operation in the data writing period P3 is performed in the full screen row by row. After the data is written, all the first signal terminal S1 and the third signal terminal S3 are at a low level in the light-emitting period P4, the fourth signal terminal S4 is at a high level, and the full screen starts to emit light.

Since each pixel only requires one first signal terminal S1 and one second signal terminal S2, and others required are common signals, the structure of driving the circuit is simple, which may greatly save a cost of a driving integrated circuit (IC).

Figure 9:
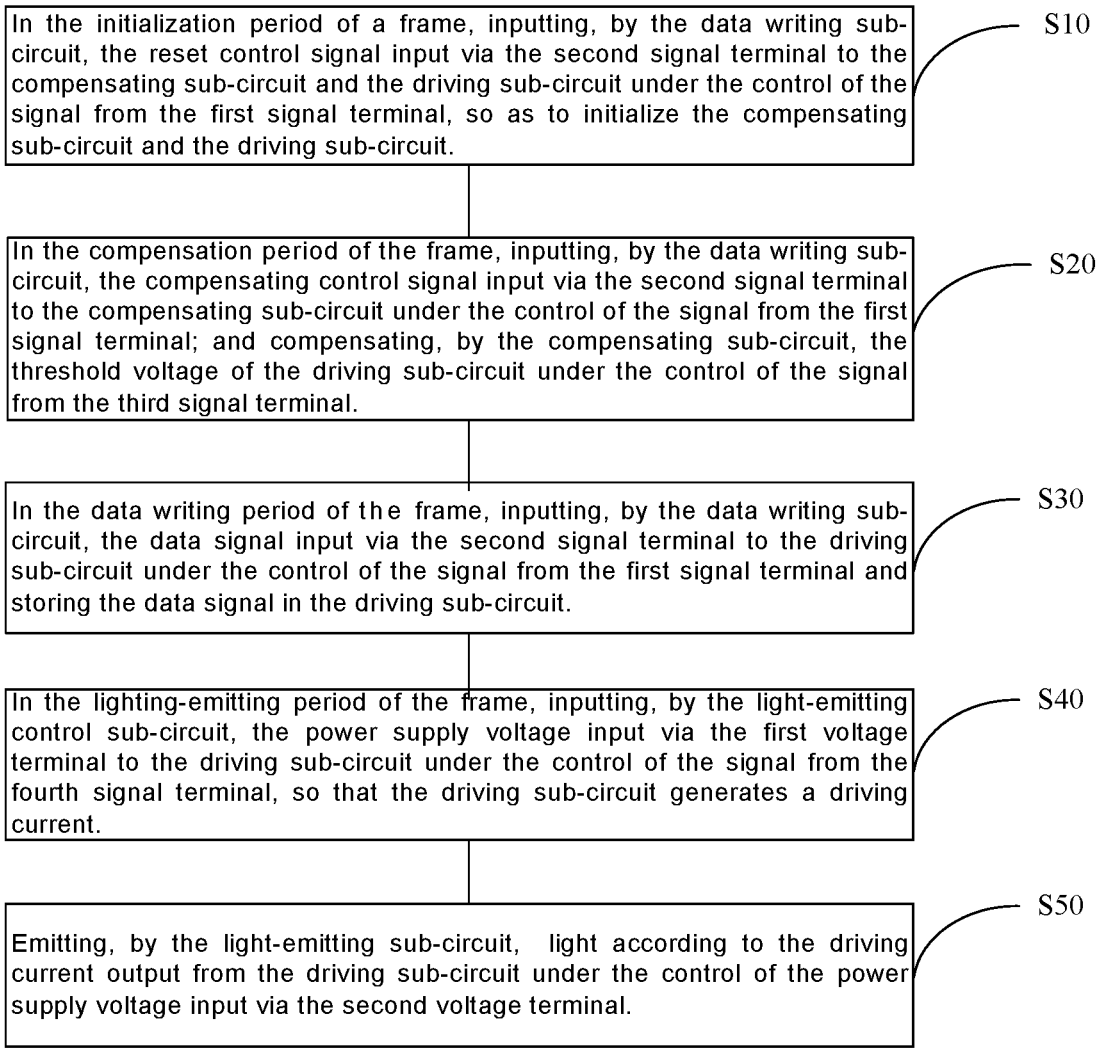
FIG. 9 is a schematic flow chart of a method of driving a pixel circuit according to some embodiments of the present disclosure.

Some embodiments of the present disclosure provide a method of driving a pixel circuit. As shown in FIG. 9, the method of driving the pixel circuit includes following steps.

In S10, in an initialization period P1 of a frame, the data writing sub-circuit 10 inputs a reset control signal input via the second signal terminal S2 to the compensating sub-circuit 20 and the driving sub-circuit 30 under the control of a signal from the first signal terminal S1, to initialize the compensating sub-circuit 20 and the driving sub-circuit 30.

In some embodiments, as shown in FIG. 2, the data writing sub-circuit 10 includes a first transistor T1, the compensating sub-circuit 20 includes a second transistor T2 and a first capacitor C1, and the driving sub-circuit 30 includes a third transistor T3 and a second capacitor C2.

Based on this, the step in which in the initialization period of the frame, the data writing sub-circuit 10 inputs the reset control signal input via the second signal terminal S2 to the compensating sub-circuit 20 and the driving sub-circuit 30 under the control of the signal from the first signal terminal S1, to initialize the compensating sub-circuit 20 and the driving sub-circuit 30, includes the following step.

In the initialization period P1 of the frame, a high level turn-on signal is input via the first signal terminal S1 to control the first transistor T1 to be turned on, a reset control signal input via the second signal terminal S2 is transmitted to the first capacitor C1 and the second capacitor C2 through the first transistor T1, to initialize the first capacitor C1 and the second capacitor C2.

Figure 10:
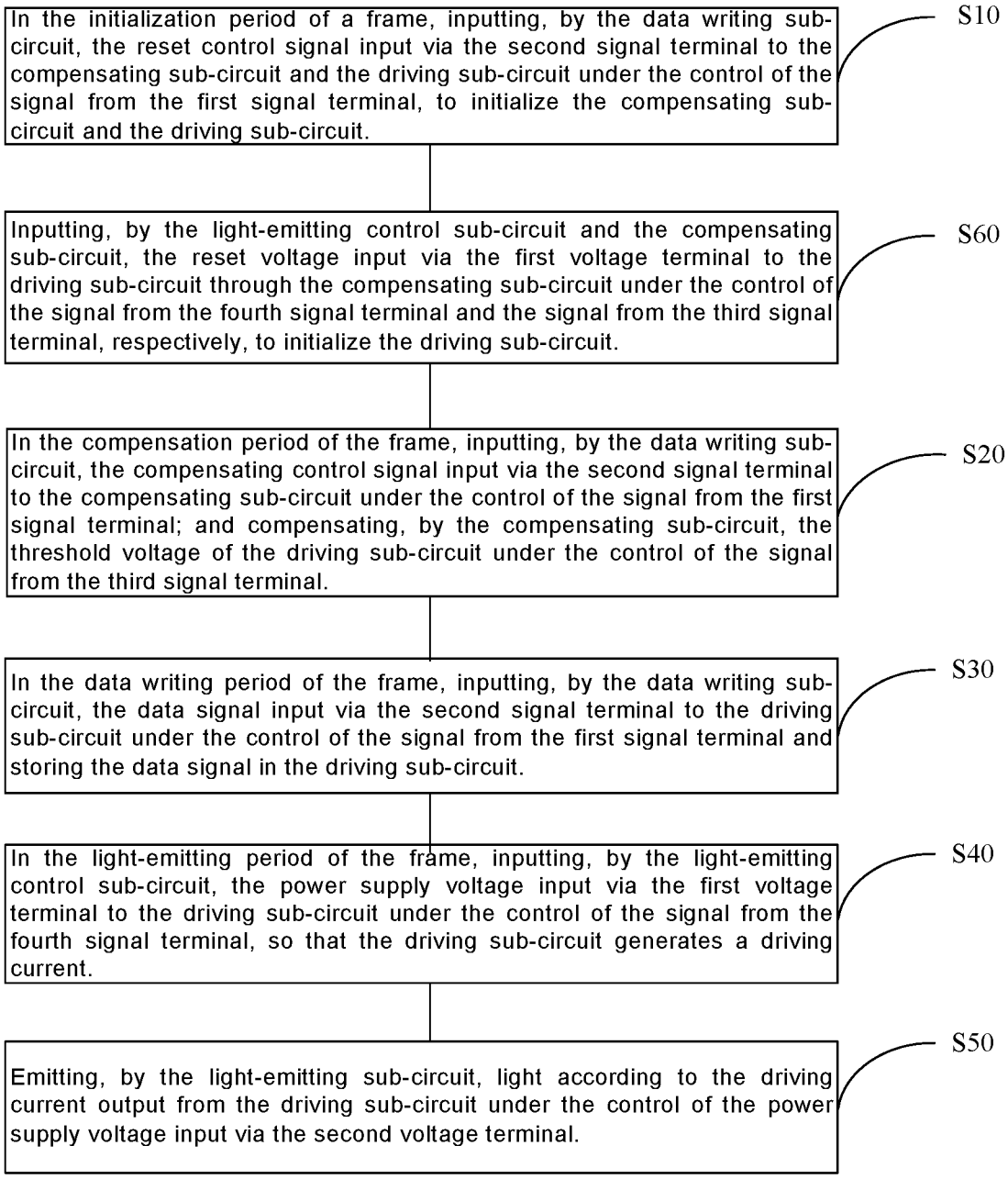
FIG. 10 is a schematic flow chart of another method of driving a pixel circuit according to some embodiments of the present disclosure.

In some embodiments, as shown in FIG. 10, in the initialization period P1 of the frame, the method of driving the pixel circuit further includes the following step. In S60, the light-emitting control sub-circuit 40 and the compensating sub-circuit 20 input a reset voltage input via the first voltage terminal V1 to the driving sub-circuit 30 through the compensating sub-circuit 20 under the control of the signal from the fourth signal terminal S4 and the signal from the third signal terminal S3, respectively, to initialize the driving sub-circuit 30.

In some embodiments, as shown in FIG. 2, the data writing sub-circuit 10 includes a first transistor T1, the compensating sub-circuit 20 includes a second transistor T2 and a first capacitor C1, the driving sub-circuit 30 includes a third transistor T3 and a second capacitor C2, and the light-emitting control sub-circuit 40 includes a fourth transistor T4.

Based on this, the step in which the light-emitting control sub-circuit 40 and the compensating sub-circuit 20 input the reset voltage input via the first voltage terminal V1 to the driving sub-circuit 30 through the compensating sub-circuit 20 under the control of the signal from the fourth signal terminal S4 and the signal from the third signal terminal S3, respectively, to initialize the driving sub-circuit 30, includes the following step.

A turn-on signal is input via the fourth signal terminal S4 to control the fourth transistor T4 to be turned on, the reset voltage input via the first voltage terminal V1 is transmitted to a gate of the third transistor T3 through the fourth transistor T4, to initialize the third transistor T3.

In S20, in the compensation period P2 of the frame, the data writing sub-circuit 10 inputs a compensating control signal input via the second signal terminal S2 to the compensating sub-circuit 20 under the control of a signal from the first signal terminal S1, and the compensating sub-circuit 20 compensates a threshold voltage of the driving sub-circuit 30 under the control of a signal from the third signal terminal S3.

In some embodiments, as shown in FIG. 2, the data writing sub-circuit 10 includes a first transistor T1, the compensating sub-circuit 20 includes a second transistor T2 and a first capacitor C1, and the driving sub-circuit 30 includes a third transistor T3 and a second capacitor C2.

Based on this, the step in which in the compensation period P2 of the frame, the data writing sub-circuit 10 inputs the compensating control signal input via the second signal terminal S2 to the compensating sub-circuit 20 under the control of the signal from the first signal terminal S1, and the compensating sub-circuit 20 compensates the threshold voltage of the driving sub-circuit 30 under the control of the signal from the third signal terminal S3, includes the following step.

In the compensation period P2 of the frame, a turn-on signal is input via the first signal terminal S1 to control the first transistor T1 to be turned on, the compensating control signal input via the second signal terminal S2 is transmitted to the compensating sub-circuit 20 through the first transistor T1, and a turn-on signal is input via the third signal terminal S3 to control the second transistor T2 to be turned on, to compensate the threshold voltage of the driving sub-circuit 30.

In S30, in the data writing period P3 of the frame, the data writing sub-circuit 10 inputs a data signal input via the second signal terminal S2 to the driving sub-circuit 30 under the control of a signal from the first signal terminal S1, and stores the data signal in the driving sub-circuit 30.

In some embodiments, as shown in FIG. 2, the data writing sub-circuit 10 includes a first transistor T1, the compensating sub-circuit 20 includes a second transistor T2 and a first capacitor C1, and the driving sub-circuit 30 includes a third transistor T3 and a second capacitor C2.

Based on this, the step in which in the data writing period P3 of the frame, the data writing sub-circuit 10 inputs the data signal input via the second signal terminal S2 to the driving sub-circuit 30 under the control of the signal from the first signal terminal S1 and stores the data signal in the driving sub-circuit 30, includes the following step.

In the data writing period P3 of the frame, the turn-on signal is input via the first signal terminal S1 to control the first transistor T1 to be turned on, the data signal input via the second signal terminal S2 is transmitted to the second capacitor C2 through the first transistor T1 and the data signal is stored in the second capacitor C2.

In S40, in the light-emitting period P4 of the frame, the light-emitting control sub-circuit 40 inputs a power supply voltage input via the first voltage terminal V1 to the driving sub-circuit 30 under the control of a signal from the fourth signal terminal S4, so that the driving sub-circuit 30 generates a driving current.

In some embodiments, the light-emitting control sub-circuit 40 includes a fourth transistor.

Based on this, the step in which in the light-emitting period P4 of the frame, the light-emitting control sub-circuit 40 inputs the power supply voltage input via the first voltage terminal V1 to the driving sub-circuit 30 under the control of the signal from the fourth signal terminal S4, so that the driving sub-circuit 30 generates a driving current, includes the following step.

In the light-emitting period P4 of the frame, a turn-on signal is input via the fourth signal terminal S4 to control the fourth transistor T4 to be turned on, and the power supply voltage input via the first voltage terminal V1 is input to the driving sub-circuit 30 through the fourth transistor T4, so that the driving sub-circuit 30 generates a driving current.

On this basis, in a case where the light-emitting sub-circuit 50 includes the light-emitting device L, the light-emitting sub-circuit 50 emits light according to the driving current output from the driving sub-circuit 30 under the control of the power supply voltage input via the second voltage terminal V2.

In S50, the light-emitting sub-circuit 50 emits light according to the driving current output from the driving sub-circuit 30 under the control of the power supply voltage input via the second voltage terminal V2.

In the method of driving the pixel circuit provided by some embodiments of the present disclosure, the compensating sub-circuit 20 is added in the pixel circuit for compensating the threshold voltage of the driving sub-circuit 30, thereby avoiding the difference in display luminance due to the difference in the threshold voltage drifts of the TFTs on different parts of the display panel, and improving the luminance uniformity among the pixels.

The foregoing descriptions are merely some specific implementation manners of the present disclosure, but the protection scope of the present disclosure is not limited thereto. Any person skilled in the art could readily conceive of changes or replacements within the technical scope of the present disclosure, which shall all be included in the protection scope of the present disclosure. Therefore, the protection scope of the present disclosure shall be subject to the protection scope of the claims.

What is claimed is:

1. A method of driving a pixel circuit, wherein the pixel circuit comprises a data writing sub-circuit, a compensating sub-circuit, a driving sub-circuit, a light-emitting control sub-circuit, and a light-emitting sub-circuit, wherein the data writing sub-circuit is coupled to the compensating sub-circuit, the driving sub-circuit, a first signal terminal and a second signal terminal; the compensating sub-circuit is further coupled to the driving sub-circuit and a third signal terminal; the light-emitting control sub-circuit is coupled to the compensating sub-circuit, the driving sub-circuit, a fourth signal terminal and a first voltage terminal; the driving sub-circuit is further coupled to the light-emitting sub-circuit; the light-emitting sub-circuit is further coupled to a second voltage terminal; and the method comprises:

in an initialization period of a frame, inputting, by the data writing sub-circuit, a reset control signal input via the second signal terminal to the compensating sub-circuit and the driving sub-circuit under the control of a signal from the first signal terminal, to initialize the compensating sub-circuit and the driving sub-circuit;

in a compensation period of the frame, inputting, by the data writing sub-circuit, a compensating control signal input via the second signal terminal to the compensating sub-circuit under the control of a signal from the first signal terminal, and compensating, by the compensating sub-circuit, a threshold voltage of the driving sub-circuit under the control of a signal from the third signal terminal;

in a data writing period of the frame, inputting, by the data writing sub-circuit, a data signal input via the second signal terminal to the driving sub-circuit under the control of a signal from the first signal terminal and storing the data signal in the driving sub-circuit, wherein the data signal is different from the compensating control signal or the reset control signal;

in a light-emitting period of the frame, inputting, by the light-emitting control sub-circuit, a power supply voltage input via the first voltage terminal to the driving sub-circuit under the control of a signal from the fourth signal terminal, so that the driving sub-circuit generates a driving current; and emitting, by the light-emitting sub-circuit, light according to the driving current under the control of a power supply voltage input via the second voltage terminal.

2. The method of driving the pixel circuit according to claim 1, wherein in the initialization period of the frame, the method further comprises:

inputting, by the light-emitting control sub-circuit and the compensating sub-circuit, a reset voltage input via the first voltage terminal to the driving sub-circuit through the compensating sub-circuit under the control of a signal from the fourth signal terminal and a signal from the third signal terminal, respectively, to initialize the driving sub-circuit.

3. The method of driving the pixel circuit according to claim 1, wherein the data writing sub-circuit comprises a first transistor, the compensating sub-circuit comprises a second transistor and a first capacitor, and the driving sub-circuit comprises a third transistor and a second capacitor;

a gate of the first transistor is coupled to the first signal terminal, a first electrode of the first transistor is coupled to the second signal terminal, and a second electrode of the first transistor is coupled to a first end of the first capacitor and a first end of the second capacitor; a second end of the first capacitor is coupled to a first electrode of the second transistor and a gate of the third transistor; a second end of the second capacitor is coupled to a second electrode of the third transistor; a gate of the second transistor is coupled to the third signal terminal, and a second electrode of the second transistor is coupled to a first electrode of the third transistor and the light-emitting control sub-circuit; the second electrode of the third transistor is further coupled to the light-emitting sub-circuit;

in the initialization period of the frame, inputting, by the data writing sub-circuit, the reset control signal input via the second signal terminal to the compensating sub-circuit and the driving sub-circuit under the control of the signal from the first signal terminal, to initialize the compensating sub-circuit and the driving sub-circuit, comprises:

in the initialization period of the frame, inputting a turn-on signal via the first signal terminal to control the first transistor to be turned on, outputting, by the first transistor, the reset control signal input via the second signal terminal to the first capacitor and the second capacitor, to initialize the first capacitor and the second capacitor.

4. The method of driving the pixel circuit according to claim 3, wherein in the compensation period of the frame, inputting, by the data writing sub-circuit, the compensating control signal input via the second signal terminal to the compensating sub-circuit under the control of the signal from the first signal terminal, and compensating, by the compensating sub-circuit, the threshold voltage of the driving sub-circuit under the control of the signal from the third signal terminal, comprises:

in the compensation period of the frame, inputting a turn-on signal via the first signal terminal to control the first transistor to be turned on, and outputting, by the first transistor, the compensating control signal input via the second signal terminal to the compensating sub-circuit, and inputting the turn-on signal via the third signal terminal to control the second transistor to be turned on, to compensate the threshold voltage of the driving sub-circuit.

5. The method of driving the pixel circuit according to claim 3, wherein in the data writing period of the frame, inputting, by the data writing sub-circuit, the data signal input via the second signal terminal to the driving sub-circuit under the control of the signal from the first signal terminal and storing the data signal in the driving sub-circuit, comprises:

in the data writing period of the frame, inputting a turn-on signal via the first signal terminal to control the first transistor to be turned on, and outputting, by the first transistor, the data signal input via the second signal terminal to the second capacitor and storing the data signal in the second capacitor.

6. The method of driving the pixel circuit according to claim 3, wherein the light-emitting control sub-circuit comprises a fourth transistor; a gate of the fourth transistor is coupled to the fourth signal terminal, a first electrode of the fourth transistor is coupled to the first voltage terminal, and a second electrode of the fourth transistor is coupled to the first electrode of the third transistor and the second electrode of the second transistor;

in the light-emitting period of the frame, inputting, by the light-emitting control sub-circuit, the power supply voltage input via the first voltage terminal to the driving sub-circuit under the control of the signal from the fourth signal terminal, so that the driving sub-circuit generates a driving current, comprises:

in the light-emitting period of the frame, inputting a turn-on signal via the fourth signal terminal to control the fourth transistor to be turned on, and inputting, by the fourth transistor, the power supply voltage input via the first voltage terminal to the driving sub-circuit, so that the driving sub-circuit generates a driving current.

7. The method of driving the pixel circuit according to claim 2, wherein the data writing sub-circuit comprises a first transistor, the compensating sub-circuit comprises a second transistor and a first capacitor, the driving sub-circuit comprises a third transistor and a second capacitor, and the light-emitting control sub-circuit comprises a fourth transistor;

a gate of the first transistor is coupled to the first signal terminal, a first electrode of the first transistor is coupled to the second signal terminal, and a second electrode of the first transistor is coupled to a first end of the first capacitor and a first end of the second capacitor; a second end of the first capacitor is coupled to a first electrode of the second transistor and a gate of the third transistor; a second end of the second capacitor is coupled to a second electrode of the third transistor; a gate of the second transistor is coupled to the third signal terminal, and a second electrode of the second transistor is coupled to a first electrode of the third transistor and a second electrode of the fourth transistor; the second electrode of the third transistor is further coupled to the light-emitting sub-circuit; a gate of the fourth transistor is coupled to the fourth signal terminal, a first electrode of the fourth transistor is coupled to the first voltage terminal; and inputting, by the light-emitting control sub-circuit and the compensating sub-circuit, the reset voltage input via the first voltage terminal to the driving sub-circuit through the compensating sub-circuit under the control of the signal from the fourth signal terminal and the signal from the third signal terminal, respectively, to initialize the driving sub-circuit, comprises:

inputting a turn-on signal via the fourth signal terminal to control the fourth transistor to be turned on, outputting, by the fourth transistor, the reset voltage input via the first voltage terminal to a gate of the third transistor, to initialize the third transistor.

8. The method of driving the pixel circuit according to claim 2, wherein the reset voltage supplied by the first voltage terminal is different from the power supply voltage supplied by the first voltage terminal.

* * * * *